United States Patent [19]

Beier

[11] Patent Number: 4,768,247

[45] Date of Patent: Sep. 6, 1988

[54] TRAVEL PILLOW

[76] Inventor: John K. Beier, 901 S. 89th, Omaha, Nebr. 68114

[21] Appl. No.: 167,777

[22] Filed: Mar. 14, 1988

[51] Int. Cl.[4] ..... A47C 20/02

[52] U.S. Cl. ..... 5/434; 5/437; 5/441; 5/450; 5/490

[58] Field of Search ..... 5/417, 420, 434, 437, 5/441, 442, 450, 490; 128/89.12; 200/524.8

[56] References Cited

U.S. PATENT DOCUMENTS

| | | | |
|---|---|---|---|
| 1,068,355 | 7/1913 | McComb . | |
| 1,950,571 | 3/1934 | Rubin . | |
| 2,029,608 | 2/1936 | Buchman . | |
| 2,779,034 | 1/1957 | Arpin | 5/450 X |
| 2,837,145 | 6/1958 | Goetz | 5/450 |
| 2,942,281 | 6/1960 | Cole . | |
| 2,997,100 | 8/1961 | Morris . | |
| 3,268,922 | 8/1966 | Moxley | 5/420 |
| 3,299,451 | 1/1967 | Trogdon . | |
| 3,411,164 | 11/1968 | Sumergrade . | |
| 3,604,026 | 9/1971 | Scheips | 5/442 |
| 3,864,766 | 2/1975 | Prete, Jr. | 5/441 |
| 3,872,525 | 3/1975 | Lea et al. | 5/450 |
| 4,277,859 | 7/1981 | Seaman | 5/434 |
| 4,712,259 | 12/1987 | Chiasson | 5/441 |

*Primary Examiner*—Michael F. Trettel

*Attorney, Agent, or Firm*—Zarley, McKee, Thomte, et al.

[57] ABSTRACT

A travel pillow comprising a pillow casing having compressible material contained therein which is selectively removably positioned within a flexible plastic bag. One end of the flexible plastic bag has a zipper or the like to enable that end of the bag to be selectively closed. A one-way air valve is provided at the other end of the bag to permit air within the bag and the pillow contained therein to be exhausted outwardly therefrom so that the thickness of the pillow may be reduced.

9 Claims, 3 Drawing Sheets

TRAVEL PILLOW

BACKGROUND OF THE INVENTION

Many people become accustomed to a particular pillow. When a person travels, it is difficult to take that person's favorite pillow with him since the pillow occupies consideration space and is difficult to pack.

Many travelers are also becoming concerned about sleeping on pillows in hotels, motels or the like for fear that the person might contract a disease from the pillow or may be subjected to germs found on the pillow.

It is therefore a principal object of the invention to provide a travel pillow.

A further object of the invention is to provide a travel pillow which may be compressed for packing and travel.

A further object of the invention is to provide a travel pillow including means for maintaining it in a rolled and compressed condition.

A further object of the invention is to provide a travel pillow including an outer plastic cover member which encloses the pillow to maintain the pillow in a sanitary condition including means for permitting the exhaust of air from the interior of the plastic cover member and pillow so that the pillow will occupy less space than normal.

These and other objects will be apparent to those skilled in the art.

SUMMARY OF THE INVENTION

Figure 1:
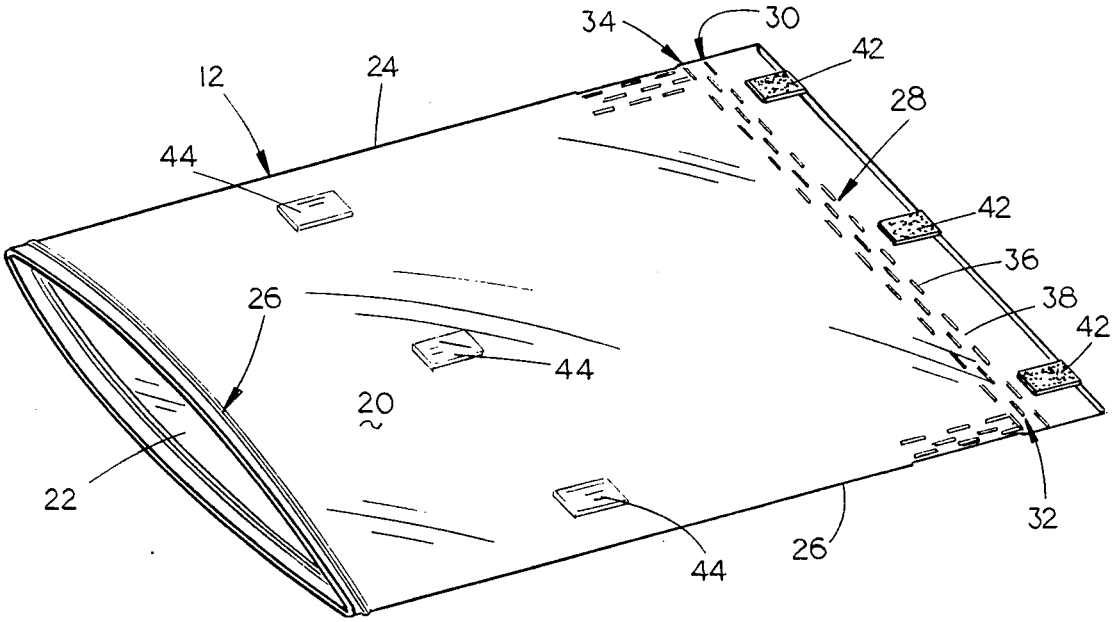
FIG. 1 is a perspective view of the flexible plastic bag which encloses the pillow portion of the invention.
Figure 2:
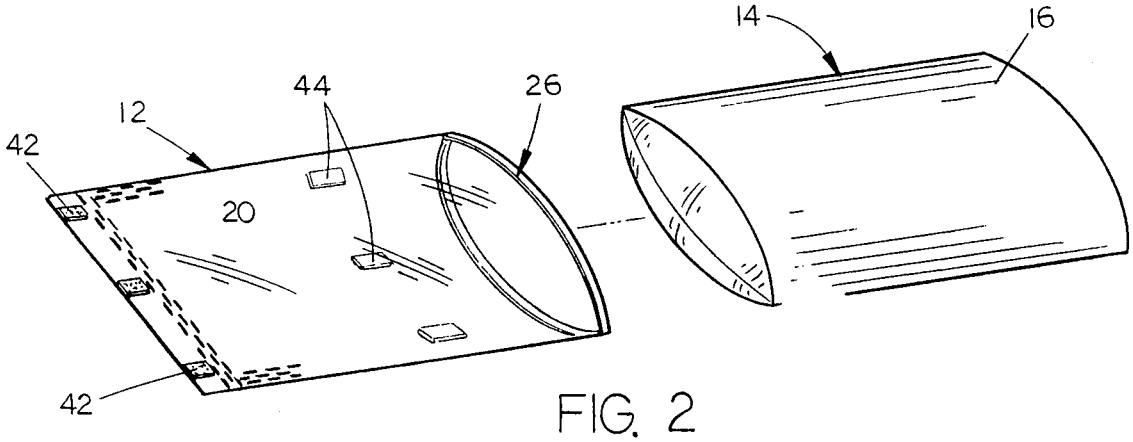
FIG. 2 is an exploded perspective view illustrating the inner pillow and its relationship to the outer plastic bag.
Figure 3:
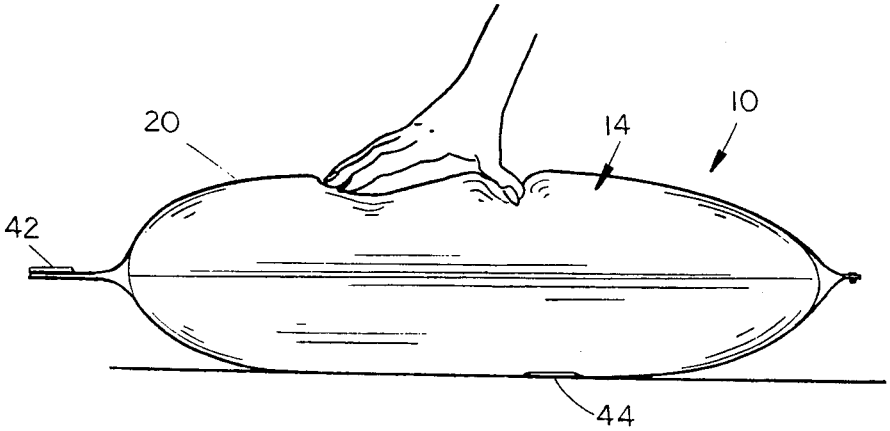
FIG. 3 is a side view illustrating the manner in which the travel pillow of this invention is initially compressed.

In the preferred embodiment, a pillow comprised of a pillow casing having compressible material contained therein is selectively removably positioned within a flexible plastic bag. One end of the flexible plastic bag may be selectively closed in a sealed manner to permit the pillow to be positioned therein or removed therefrom. At the other end of the bag there is provided a one-way air valve means which permits the air within the bag and pillow contained therein to be exhausted outwardly therefrom so that the thickness of the pillow may be reduced. When the pillow has been compressed, the air valve means temporarily prevents air from reentering the interior of the bag thereby permitting the pillow to be either placed in a flattened condition in a suitable carrier or to permit the pillow to be rolled. If the pillow is rolled, the bag is provided with means for maintaining the pillow and bag in the rolled condition.

DESCRIPTION OF THE PREFERRED EMBODIMENT

The travel pillow of this invention is referred to generally by the reference numeral 10 and is comprised of an outer plastic bag 12 having a pillow 14 removably positioned therein. Pillow portion 14 is comprised of an outer pillow case 16 having compressible material 18 contained therein which may be comprised of polyurethane foam, polyester fiber, foam rubber, down, etc. However, in the preferred embodiment the compressible material 18 would be polyester fiber.

Bag 12 is comprised of sheet members 20 and 22 joined along their sides 24 and 26 in conventional fashion. A conventional plastic zipper 26 is provided at one end of sheet members 20 and 22 for selectively sealably closing one end of the bag at times as will be described in more detail hereinafter. Preferably, zipper 26 is of the type commonly known as ZIP-LOCK TM. The numeral 28 refers generally to a one-way air valve means provided at the other end of the bag for permitting the escape of air from the interior of the bag, when zipper 26 is closed, so that the pillow portion 14 may be compressed as will also be described hereinafter.

Figure 5:
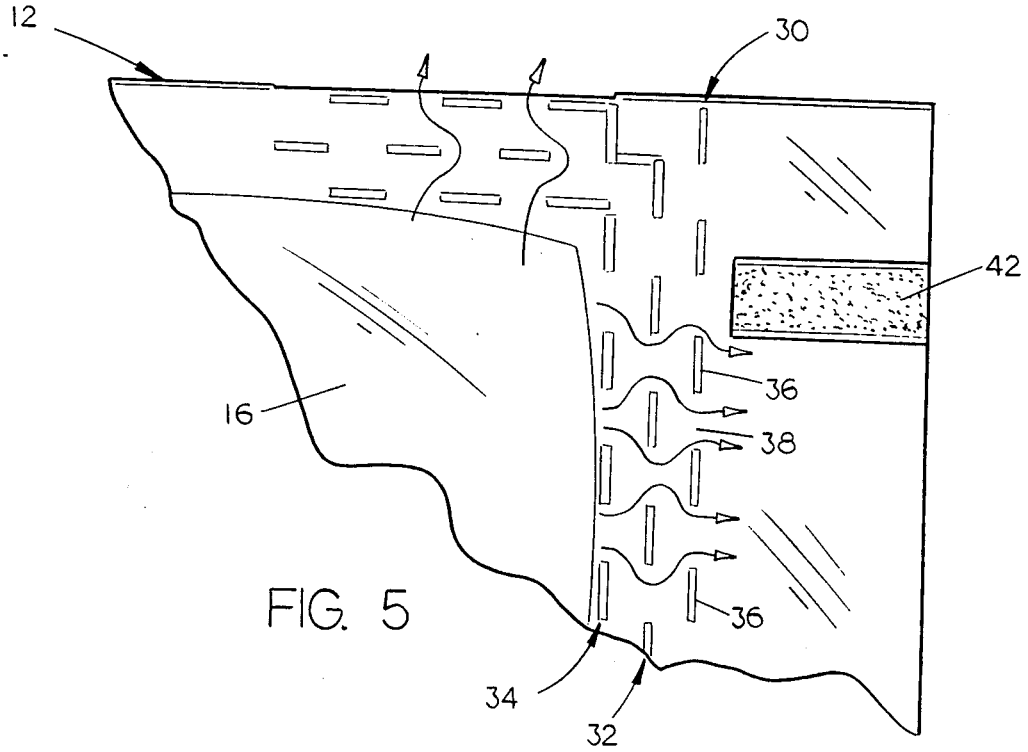
FIG. 5 is a partial top view of the invention.

Valve means 28 is comprised of a plurality of rows 30, 32 and 34 of spaced apart seals 36 which are separated by gaps or spaces 38. Seals 36 join sheet members 20 and 22 together and are formed by either heat sealing or by ultrasonic means. As seen in the drawings, the seals and gaps 38 in each of the rows 30, 32 and 34 are staggered so as to provide circuitous air passageways as illustrated by the arrows in FIG. 5 Preferably, the air valve means 28 also extends partially up along the sides of the bag 12 as illustrated in the drawings.

Figure 4:
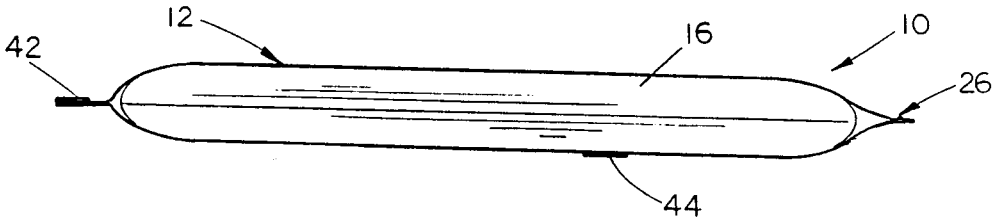
FIG. 4 is a side view similar to FIG. 3 illustrating the pillow of FIG. 3 in its compressed condition.

When it is desired to take the pillow 10 on a trip, zipper 26 is opened and the pillow portion 14 is inserted into the bag 12. Zipper 26 is then closed to seal the end of the bag. If it is desired to transport the pillow in a flattened condition, the person simply needs to apply downward pressure on the pillow to compress the compressible material within the pillow portion 14 which will cause the air in the interior of the bag and the pillow portion to be exhausted outwardly through the air valve means 28. When the air has been so exhausted the pillow will assume the flattened condition illustrated in FIG. 4. The pillow may then be placed in a suitcase or the like in the flattened condition for transport. If it is desired to transport the pillow in a rolled and compressed condition, it is recommended and preferred that the bag 12 be provided with some means for maintaining the rolled pillow in its compressed condition.

Figure 6:
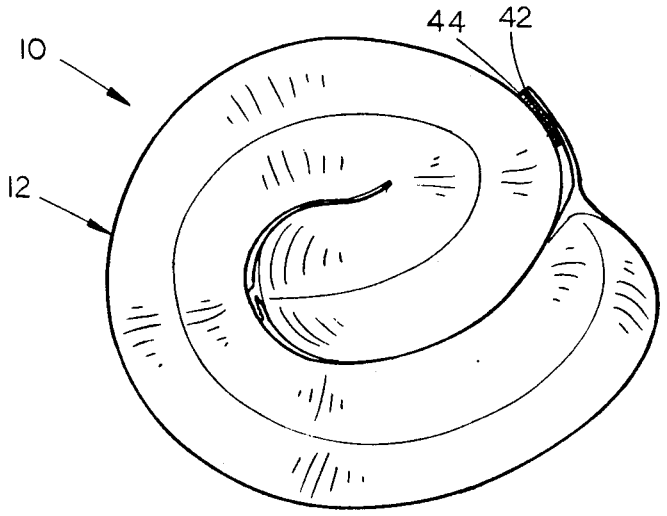
FIG. 6 is an end view illustrating the travel pillow in its rolled travel condition.
Figure 7:
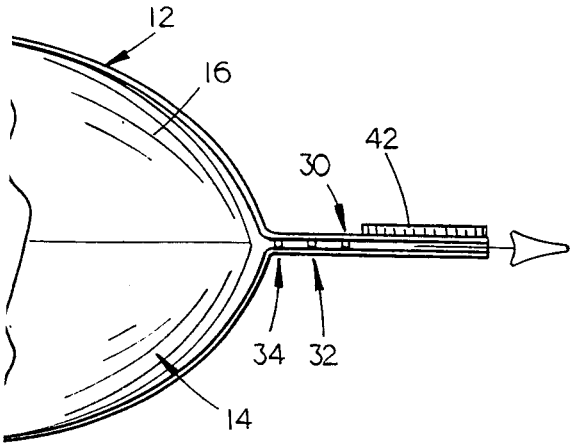
FIG. 7 is a partial end view of the invention.
Figure 8:
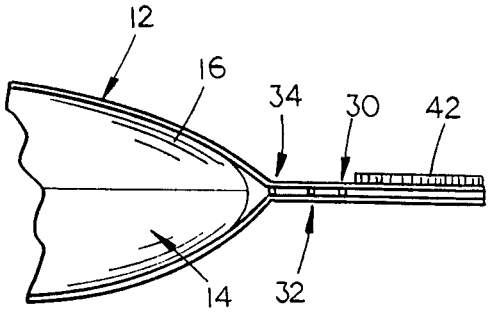
FIG. 8 is a view similar to FIG. 7 but which illustrates the travel pillow in its compressed condition.

One means for maintaining the pillow in its rolled and compressed position is illustrated in FIGS. 1–6 where it can be seen that a plurality of hook and loop type fastener strips 42 sold under the trademark Velcro are provided at one end of bag 12. Bag 12 is also provided with a plurality of strips 44 thereon of the Velcro type. Each of the strips 42 and 44 form one-half of the conventional Velcro fastener. For example, strips 42 may be of the hook type while strips 44 may be of the latch type. Thus, the pillow, after being compressed, may be rolled from the end having the zipper 26 provided thereon towards the other end of the bag. When the bag has been completely rolled in its compressed condition, as seen in FIG. 6, the coacting hook and latch strips 42 and 44 may be joined to maintain the bag in its rolled and compressed condition.

Figure 9:
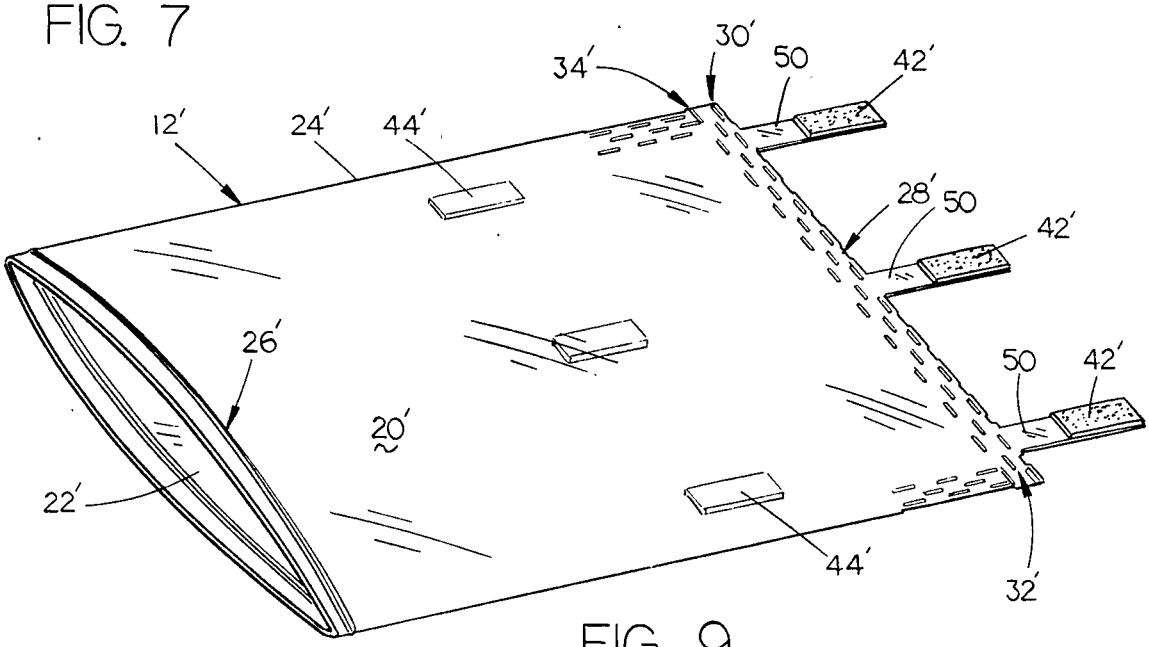
FIG. 9 is a perspective view similar to FIG. 1 except that a modified form of the invention is illustrated.
Figure 10:
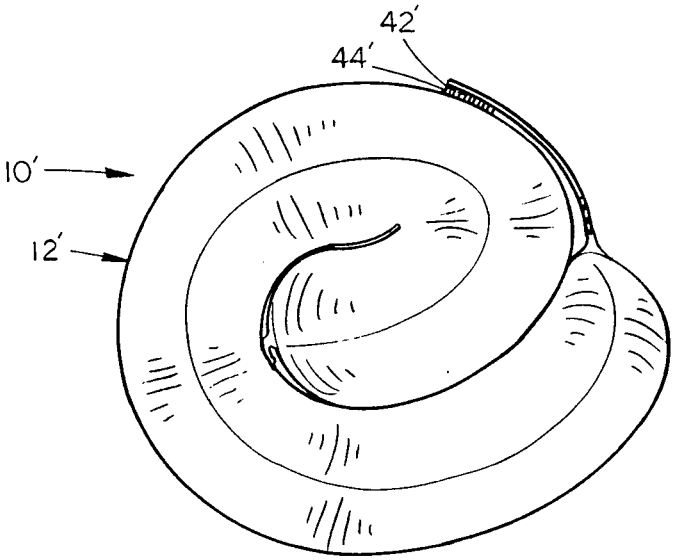
FIG. 10 is a view similar to FIG. 6 except that the modified form of the invention is illustrated.

A modified form of the means for maintaining the bag in the rolled and compressed condition is illustrated in FIGS. 9 and 10. As seen in FIG. 9, a plurality of strips 44' are positioned in the same general location as the strips 44 in the previous embodiment. The device is provided with a plurality of straps 50 which extend from one end thereof and which have Velcro strips 42' provided theron. Once the bag of FIG. 9 has been compressed, it is rolled into the configuration seen in FIG. 10 with the Velcro strips 42' placed in engagement with the strips 44' to maintain the pillow in its rolled and compressed condition.

When it is desired to use the pillow, the Velcro strips are disengaged and the pillow is unrolled. The zipper 26 is then opened to permit the removal of the pillow portion 14.

Thus, it can be seen that the travel pillow of this invention accomplishes at least all of its stated objectives.

I claim:

1. A travel pillow, comprising, a substantially, flexible, flat, rectangular bag having first and second ends, a pillow selectively removably positioned with said bag comprising an outer pillow casing having compressible material contained therein, means selectively closing said first end of said bag to permit said pillow to be placed within said bag and to be removed therefrom, an one-way air valve at said second end of said bag for permitting air to escape outwardly therethrough from the interior of said bag when said pillow is compressed to reduce the size thereof for travel.

2. The pillow of claim 1 wherein means is provided for maintaining the bag and pillow in a compressed and rolled condition.

3. The travel pillow of claim 2 wherein said means for maintaining said pillow in a compressed and rolled condition comprises coacting fastener means mounted on opposite sides of said bag which may be brought into coacting fastening engagement.

4. The travel pillow of claim 2 wherein said means for maintaining said pillow in a compressed and rolled condition comprises a plurality of flexible straps secured to said bag and extending from said second end, and coacting fastener means on said straps and said bag.

5. The travel pillow of claim 2 wherein said one-way air valve means extends across the entire width of said second end.

6. The travel pillow of claim 5 wherein said bag comprises first and second sheet members having first and second ends and opposite side edges, said side edges being joined together, said one-way valve means comprising a plurality of spaced apart rows of spaced apart seals which join said first and second sheet members together, the seals of said rows being staggered to provide a plurality of circuitous air passageways.

7. The travel pillow of claim 6 wherein said seals are created by heat sealing said sheet members.

8. The travel pillow of claim 6 wherein said seals are created ultrasonically.

9. The travel pillow of claim 5 wherein said one-way air valve means also extends partially along the sides of said bag adjacent said second end.

* * * * *